US006782689B1

(12) United States Patent
Philipp

(10) Patent No.: US 6,782,689 B1
(45) Date of Patent: Aug. 31, 2004

(54) METHOD OF MAKING A CHAIN

(75) Inventor: Günther Philipp, Schwerte (DE)

(73) Assignee: Thiele GmbH & Co. KG, Iserlohn (DE)

( * ) Notice: Subject to any disclaimer, the term of this patent is extended or adjusted under 35 U.S.C. 154(b) by 0 days.

(21) Appl. No.: 10/638,129

(22) Filed: Aug. 8, 2003

Related U.S. Application Data

(63) Continuation of application No. PCT/DE02/00089, filed on Jan. 15, 2002.

(30) Foreign Application Priority Data

Feb. 8, 2001 (DE) ..... 101 05 809

(51) Int. Cl.[7] ..... F16G 15/00
(52) U.S. Cl. ..... 59/35.1; 59/78; 59/29; 59/84
(58) Field of Search ..... 59/78, 84, 90, 59/29, 35.1

(56) References Cited

U.S. PATENT DOCUMENTS

| | | | | |
|---|---|---|---|---|
| 3,707,072 A | * | 12/1972 | Elaasser | 59/35 |
| 3,802,477 A | * | 4/1974 | Sobota | 59/84 |
| 3,830,054 A | | 8/1974 | Tamamura | |
| 3,870,094 A | * | 3/1975 | Schurle et al. | 59/90 |
| 4,106,542 A | * | 8/1978 | Dohmeier | 59/78 |
| 4,428,781 A | * | 1/1984 | Norstrom | 59/84 |
| 4,649,977 A | * | 3/1987 | Weidler | 59/78 |
| 4,660,611 A | * | 4/1987 | Gockley et al. | 59/31 |

FOREIGN PATENT DOCUMENTS

| | | |
|---|---|---|
| DE | 21 39 115 | 2/1973 |
| DE | 28 44 848 | 4/1980 |
| DE | 322 38 716 | 6/1983 |
| DE | 198 06 719 | 10/1988 |
| DE | 198 21 674 | 2/2000 |
| DE | 198 28 048 | 8/2000 |
| WO | WO 00 68443 | 11/2000 |

OTHER PUBLICATIONS

Solle: Betriebsergebnisse an Stählen für hochfeste Hebezeugketten, in: Neue Hütte, 26th year, vol. 9, Sep. 1981.

* cited by examiner

*Primary Examiner*—David Jones
(74) *Attorney, Agent, or Firm*—Henry M. Feiereisen

(57) ABSTRACT

In a method of making a chain, in particular a round steel chain of tempered steel, a chain strand is produced in a conventional manner and subject to the usual heat treatment of normalizing, hardening and annealing. Annealing is implemented at a low temperature level of below 200° C. A tempered steel is used having a microstructure which, after hardening and annealing, has a stable residual austenite content between 3% and 10%. After the final calibration process, the chain strand is subjected to a thermal aftertreatment at a temperature between 190° C. and 250° C. This relieves stress resulting from the calibration process and the associated work-hardening. In this way, the notch impact energy capacity is enhanced.

14 Claims, 2 Drawing Sheets

METHOD OF MAKING A CHAIN

CROSS-REFERENCES TO RELATED APPLICATIONS

This application is a continuation of prior filed copending PCT International application no. PCT/DE02/00089, filed Jan. 15, 2002, on which priority is claimed under 35 U.S.C. §120, the disclosure of which is hereby incorporated by reference.

This application claims the priority of German Patent Application, Serial No. 101 05 809.8, filed Feb. 8, 2001, pursuant to 35 U.S.C. 119(a)–(d), the disclosure of which is incorporated herein by reference.

BACKGROUND OF THE INVENTION

The present invention relates to a method of making a chain, in particular a round steel chain of tempered steel.

Chains are assembled of single links and used as pulling elements, driving elements or conveying elements. In general, link chains which have single links that interlock for spatial movement, are distinguished from articulated chains which have individual links that are interconnected by bolts for rotation movement in a plane. Link chains are made of drawn wires or rolled round steels on an industrial scale. Therefore, they are referred to as round steel chains and used for lifting and moving loads as well as for securing a shipment and also for transporting bulk material. In view of their spatial mobility, they are especially suited for use in underground coal mining.

The demands on used materials are essentially characterized by the interaction of high strength (hardness) and minimum values for the notch impact energy to thereby ensure a high wear-resistance and resistance to fracture when exposed to operational stress.

Further requirements are dictated by the applied manufacturing process. This involves the use of steels that are suitable for electric resistance welding processes, in particular for flash-butt welding. This requirement necessarily results in a limitation of the carbon equivalent.

The currently governing steel standard for welded round steel chains is reflected in DIN 17115 from the year 1987. This standard relates to special steels with specified contents of manganese, chromium, nickel or molybdenum as well as limited values of phosphor and sulfur. A typical member of this material group from which currently high-quality chains are usually made involves a steel of grade 23MnNiMoCr54. The narrow analytic limitations as well as the regulations with respect to mechanical-technological values should ensure a high uniformity of the finished chains. Modified materials may be used for particular purposes. Examples of additional alloy elements include vanadium, tungsten or titanium.

After hardening, the steels are normally annealed at a temperature range of about 500° C. resulting in tensile strengths of up to 1,250 MPa in conjunction with notch impact energy values of at least 60 J. After annealing, the chain is calibrated in a stretching operation to thereby realize the demanded chain geometry and to improve the precision fit, in particular with respect to the interaction of the chain with drive wheels. The enhancement of the chain through calibration is, however, accompanied with a work-hardening and a drop in the notch impact energy capacity. The work-hardening is considerably more pronounced in chains of higher strength than in standard chains. A problem during operation arises, when the drop in notch impact energy is about 10 J to 15 J in chains of higher strength and the hereby associated susceptibility to brittle fracture.

From the standpoint of the user, a further increase of the chain strength is demanded while still preventing a decrease in resistance to brittle fracture. A chain of steel having notch impact energy values between 35 J and 40 J after annealing would be unsuitable in practical operation, especially for the use in coal mining It would therefore be desirable and advantageous to provide an improved method of making a chain to obviate prior art shortcomings and to produce a chain with a tensile strength of above 1,550 MPa and a notch impact energy of at least 55 J.

SUMMARY OF THE INVENTION

According to one aspect of the present invention, a method of making a chain, in particular a round steel chain of tempered steel, includes the steps of combining chain links to produce a chain strand, subjecting the chain strand to a heat treatment, calibrating the chain strand, and subjecting the chain strand to a thermal aftertreatment at a temperature between 190° C. and 250° C.

According to another feature of the present invention, the thermal aftertreatment may be implemented at a temperature between 210° C. and 240° C. e.g. at about 230° C.

The present invention resolves prior art problems by providing a thermal aftertreatment after calibration. Through the provision of the thermal aftertreatment, stress resulting from the final calibration process is relieved. While the tensile strength drops as a consequence of the thermal aftertreatment as does also the yield point, the notch impact energy increases, however, to values above 55 J. The tensile strength still remains above 1,550 MPa despite the drop as a result of the thermal pretreatment. The toughness of the chain is derived from a residue in austenite in the microstructure of the tempered steel and is responsible for the increase in notch impact energy during the thermal aftertreatment. The invention thus departs from the current teaching to avoid austenite in steel because of its highly adverse affect in traditional special steels to decrease strength.

According to another feature of the present invention, the initial heat treatment is implemented by the steps of normalizing, hardening and annealing. Annealing is implemented at a low temperature level under 200° C., e.g. 190° C. The tempered steel used has a microstructure with a stable residual austenite content of between 3% and 10% after hardening and annealing. After the final calibration process for realizing the chain link geometry and thus the precision fit, the chain strand is subjected to the thermal aftertreatment at a temperature between 190° C. and 250° C.

Normalizing may be carried out at a temperature between 900° C. and 1,100° C., followed by cooling with air. Thereafter, the chain strand is hardened at a temperature between 900° C., and 1,000° C. followed by quenching with water. Annealing is realized at a temperature between 180° C. and 200° C. at a retention time of typically four hours and by cooling with air.

According to another feature of the present invention, the chain strand may be tempered immediately after the calibrating step (main calibration), and recalibrated after the tempering step and before the thermal aftertreatment step. The main calibration is thus carried out prior to tempering. Tempering is followed by a recalibration to provide the final chain geometry. A distortion that may be caused during the hardening operation is thus eliminated. Thereafter, the thermal aftertreatment is carried out.

The thermal aftertreatment not only results in an increase in notch impact energy but also in a drop of the modulus of elasticity of the chain. As a result, the chain exhibits a softer spring characteristic. This has practical advantages, in particular in underground coal mining, because an increase in face length is accompanied by an ever increase in the length of the chains which are accordingly sensitive to vibrations. The vibrations can be compensated by the soft spring characteristics of a chain made by the method according to the invention.

According to another feature of the present invention, the tempered steel may be based on a steel alloy containing, by weight percent, between 0.20% and 0.27% of carbon (C), between 1.90% and 2.00% of chromium (Cr), between 1.30% and 1.70% of manganese (Mn), with copper fractions (Cu) between 0.20% to 0.50%, nickel fractions (Ni) between 0.15% and 0.40%, aluminum fractions (Al) of up to 0.03%, molybdenum fractions (Mo) of up to 0.05%, titanium fractions (Ti) of up to 0.04%, niobium fractions (Nb) of up to 0.04%, and silicon fractions (Si) of up to 0.05%, with the phosphor fraction below 0.01% and the nitrogen fraction (N) below 0.02%. Preferably, the copper fraction (Cu) may be between 0.45% and 0.50%. Also the nickel fraction may preferably be at an upper limit of the analytic range, i.e. for example at 0.35% to 0.40%.

According to another feature of the present invention, the tempered steel may have a chemical composition as mass parts in percent (%) as follows: 0.23 C, 0.05 Si, 1.50 Mn, ≦0.01 P, ≦0.004 S, 1.95 Cr, 0.37 Ni, 0.02 Mo, 0.028 Al, 0.5 Cu, 0.02 Ti, 0.024 Nb, 0.0105 N.

A chain made from such tempered steel is annealed during the heat treatment preferably at a temperature of about 190° C., and during the thermal aftertreatment at a temperature of about 210° C. Practical tests have shown that such a chain reliably attains a tensile strength of 1,600 MPa and more, with notch impact energy values between 55 J and 65 J. Load changes of more than 1,000,000 can be realized in fatigue tests.

According to another feature of the present invention, a tempered steel may be based on a steel alloy having the following composition, by weight percent, to produce a chain strand with very good mechanical properties: 0.18% to 0.24% of carbon (C), 1.60% to 1.80% of chromium (Cr), 0.75% to 1.00% of manganese (Mn), 0.50% to 0.85% of nickel (Ni), 0.20% to 0.30% of molybdenum (Mo), 0.01% to 0.10% of titanium (Ti), 0.20% to 0.40% of silicon (Si), 0.015% to 0.03% of aluminum (Al), and 0.001% to 0.0035% of boron (B). The phosphor fraction (P) is below 0.025%, and the nitrogen fraction (N) does not exceed 0.010%, in particular is smaller than 0.003%. The balance is formed by iron (Fe), including melting-based impurities.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

The depicted embodiments are to be understood as illustrative of the invention and not as limiting in any way. In certain instances, details which are not necessary for an understanding of the present invention or which render other details difficult to perceive may have been omitted.

Figure 1:
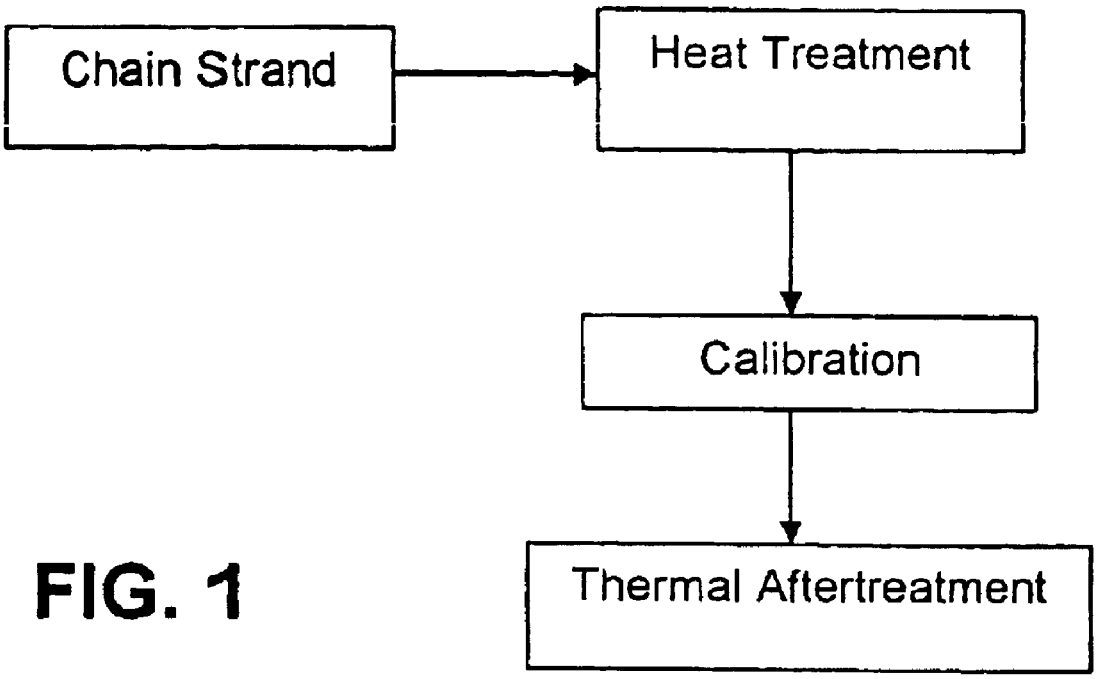
FIG. 1 is a block diagram showing the principal method steps for making a chain in accordance with the present invention.

Turning now to the drawing, and in particular to FIG. 1, there is shown a block diagram showing the principal method steps for making a chain, in particular a round steel chain, in accordance with the present invention. A plurality of chain links (not shown) are made of tempered steel and combined to form a chain strand. The tempered steel may be based on a steel alloy having a composition, containing by weight percent, 0.20% and 0.27% of carbon (C), between 1.900% and 2.00% of chromium (Cr), between 1.30% and 1.70% of manganese (Mn), with copper fractions (Cu) between 0.20% to 0.50%, nickel fractions (Ni) between 0.15% and 0.40%, aluminum fractions (Al) of up to 0.03%, molybdenum fractions (Mo) of up to 0.05%, titanium fractions (Ti) of up to 0.04%, niobium fractions (Nb) of up to 0.04%, and silicon fractions (Si) of up to 0.05%, with the phosphor fraction below 0.01% and the nitrogen fraction (N) below 0.02%. Preferably, the copper fraction (Cu) may be between 0.45% and 0.50%. Also the nickel fraction may preferably be at an upper limit of the analytic range, i.e. for example at 0.35% to 0.40%.

Another example of a chemical composition of a suitable tempered steel contains, by weight percent (%), 0.23 C, 0.05 Si, 1.50 Mn, ≦0.01 P, ≦0.004 S, 1.95 Cr, 0.37 Ni, 0.02 Mo, 0.028 Al, 0.5 Cu, 0.02 Ti, 0.024 Nb, 0.0105 N.

Figure 2:
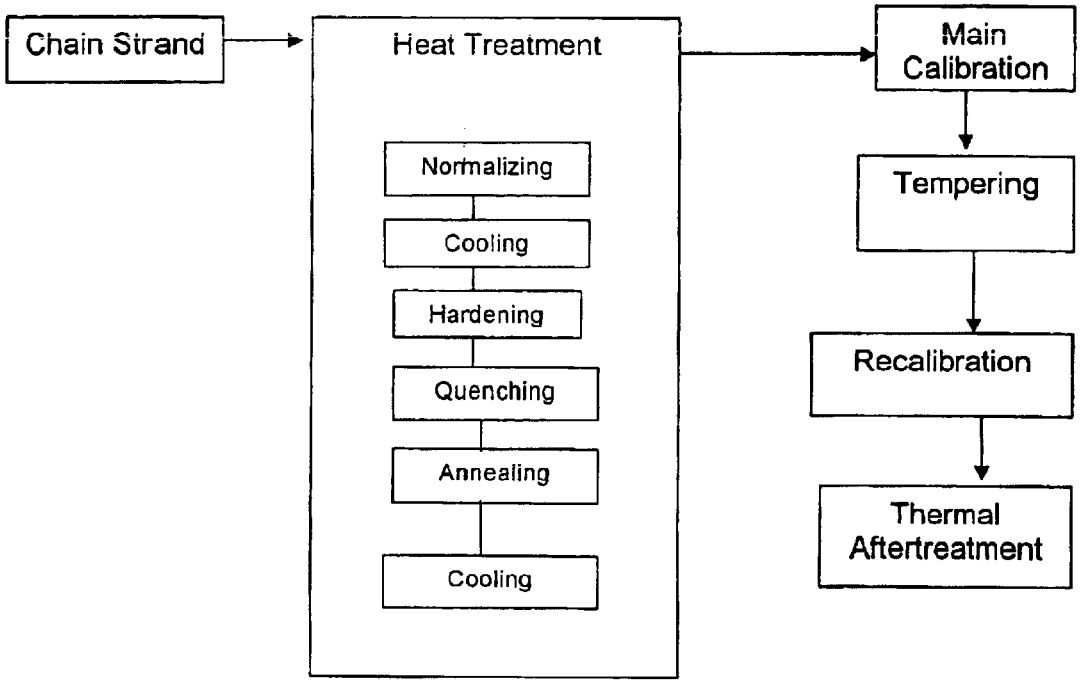
FIG. 2 is a block diagram showing a a more detailed overview of the method steps for making a chain in accordance with the present invention.

The chain strand is then subjected to a heat treatment. As shown in FIG. 2, the heat treatment comprises the steps of normalizing, hardening and annealing. After hardening and annealing, the tempered steel has a microstructure with a residual austenite content between 3% and 10%. Following the heat treatment, the chain strand is calibrated to provide a proper geometry of the chain strand. Subsequently, the chain strand is subjected to a thermal aftertreatment at a temperature between 190° C. and 250° C., preferably between 210° C. and 240° C., e.g. about 230° C.

As shown in FIG. 2, the initial heat treatment includes the steps of normalizing, hardening and annealing. Normalizing may be carried out at a temperature between 900° C and. 1,100° C., followed by cooling with air. Thereafter, the chain strand is hardened at a temperature between 900° C. and 1,000° C., followed by a quenching with water. Annealing is realized at a temperature between 180° C. and 200° C. preferably 190° C., at a retention time of typically four hours and by cooling with air. As is further shown in FIG. 2, the chain strand may be tempered immediately after the calibrating step (main calibration), and recalibrated after the tempering step and before the thermal aftertreatment step. The main calibration is thus carried out prior to tempering. Tempering is followed by a recalibration to provide the final chain geometry.

After the final calibration process for realizing the chain link geometry and thus the precision fit, the chain strand is subjected to the thermal aftertreatment at a temperature between 190° C. and 250° C., as described above.

Through the provision of the thermal aftertreatment, stress resulting from the final calibration process is relieved. While the tensile strength drops as a consequence of the thermal aftertreatment as does also the yield point, the notch impact energy increases, however, to values above 55 J. The tensile strength still remains above 1,550 MPa despite the drop as a result of the thermal pretreatment. The toughness of the chain is derived from a residue in austenite in the microstructure of the tempered steel and is responsible for the increase in notch impact energy during the thermal aftertreatment. The thermal aftertreatment not only results in an increase in notch impact energy but also in a drop of the modulus of elasticity of the chain. As a result, the produced chain exhibits a softer spring characteristic which is advantageous in conjunction with lengthy chains.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A method of making a chain, in particular a round steel chain of tempered steel, comprising the steps of:

combining chain links to produce a chain strand;

subjecting the chain strand to a heat treatment;

calibrating the chain strand; and subjecting the chain strand to a thermal aftertreatment at a temperature between 190° C. and 250° C.

2. The method of claim 1, wherein the thermal aftertreatment step is implemented at a temperature between 210° C. and 240° C.

3. The method of claim 1, wherein the thermal aftertreatment step is implemented at a temperature of about 230° C.

4. The method of claim 1, wherein the heat treatment step includes the steps of normalizing the chain strand at a temperature between 900° C. and 1,100° C., air cooling the chain strand, hardening the chain strand at a temperature between 900° C. and 1,000° C., quenching the chain strand, annealing the chain strand at a temperature between 180° C. and 200° C., and air cooling the chain strand.

5. The method of claim 1, and further comprising the steps of tempering the chain strand immediately after the calibrating step, and recalibrating the chain strand after the tempering step and before the thermal aftertreatment step.

6. The method of claim 1, wherein the chain links are made of a tempered steel on the basis of a steel alloy, comprising, by weight percent,

| | |
|---|---|
| Carbon (C) | 0.20% to 0.27% |
| Chromium (Cr) | 1.90% to 2.00% |
| Manganese (Mn) | 1.30% to 1.70% |

-continued

| | |
|---|---|
| Copper (Cu) | 0.20% to 0.50% |
| Nickel (Ni) | 0.15% to 0.40% |
| Aluminum (Al) | ≦0.03% |
| Molybdenum (Mo) | ≦0.05% |
| Titanium (Ti) | ≦0.04% |
| Niobium (Nb) | ≦0.04% |
| Silicon (Si) | ≦0.05% |
| Phosphor | ≦0.01% |
| Nitrogen (N) | ≦0.02%, |

the balance iron (Fe), including incidental impurities.

7. A method of claim 1, wherein the chain links are made of a tempered steel on the basis of a steel alloy, comprising, by weight percent,

| | |
|---|---|
| Carbon (C) | 0.18% to 0.24% |
| Chromium (Cr) | 1.60% to 1.80% |
| Manganese (Mn) | 0.75% to 1.00% |
| Nickel (Ni) | 0.50% to 0.85% |
| Molybdenum (Mo) | 0.20% to 0.30% |
| Titanium (Ti) | 0.01% to 0.10% |
| Silicon (Si) | 0.20% to 0.40% |
| Aluminum (Al) | 0.015% to 0.03% |
| Boron (B) | 0.001% to 0.0035% |
| Phosphor | ≦0.025% |
| Nitrogen (N) | ≦0.010%, |

the balance iron (Fe), including incidental impurities.

8. The method of claim 1, wherein the chain links are made of a tempered steel having a residual austenite content between 3% and 10%.

9. The method of claim 4, wherein the annealing temperature is 190° C.

10. The method of claim 4, wherein the annealing step is carried out at a retention time of 4 hours.

11. The method of claim 1, wherein the chain links are made of a tempered steel containing, by weight percent, 0.23 C, 0.05 Si, 1.50 Mn, ≦0.01 P, ≦0.004 S, 0.028 Al, 0.5 Cu, 0.02 Ti, 0.024 Nb, 0.0105 N.

12. The method of claim 7, wherein the nitrogen content is smaller than 0.003%.

13. The method of claim 6, wherein the copper content is between 0.45% and 0.50%.

14. The method of claim 6, wherein the nickel content is in a range from 0.35% to 40%.

* * * * *

UNITED STATES PATENT AND TRADEMARK OFFICE

CERTIFICATE OF CORRECTION

PATENT NO. : 6,782,689 B1
DATED : August 31, 2004
INVENTOR(S) : Günther Philipp

It is certified that error appears in the above-identified patent and that said Letters Patent is hereby corrected as shown below:

Column 4,
Line 12, delete "1,900%" insert -- 1,90% --

Column 6,
Line 41, following "0,004 S" insert -- 1,95 Cr, 0,37 Ni, 0,02 Mo --

Signed and Sealed this

First Day of February, 2005

JON W. DUDAS
*Director of the United States Patent and Trademark Office*